US005629480A

United States Patent [19]

Herget

[11] Patent Number: 5,629,480

[45] Date of Patent: May 13, 1997

[54] ROCK EXTENSOMETER

[75] Inventor: Gerhard Herget, Kanata, Canada

[73] Assignee: Her Majesty the Queen in right of Canada, as represented by the Minister of Natural Resources, Ottawa, Canada

[21] Appl. No.: 500,156

[22] Filed: Jul. 10, 1995

[30] Foreign Application Priority Data

Jan. 25, 1995 [CA] Canada ..... 2141086

[51] Int. Cl.[6] ..... E21B 47/04; E21B 47/08

[52] U.S. Cl. ..... 73/152.46; 73/784; 33/544; 166/66

[58] Field of Search ..... 73/151, 152, 866.5, 73/768, 775, 781, 783, 784, 786, 803; 166/66, 255.1, 250.01; 33/544, 544.3, 544.5, 544.6, 542.1

[56] References Cited

U.S. PATENT DOCUMENTS

| | | | |
|---|---|---|---|
| 2,267,110 | 12/1941 | Kinley et al. . | |
| 2,639,512 | 5/1953 | Legrand . | |
| 2,640,271 | 6/1953 | Boucher . | |
| 2,651,199 | 8/1953 | Collins et al. | 73/151 |
| 2,656,613 | 10/1953 | Goble | 73/151 |
| 2,736,967 | 3/1956 | Doll | 33/178 |
| 2,744,181 | 5/1956 | Rea | 73/781 |
| 2,879,604 | 3/1959 | Chaney et al. | 33/544.3 |
| 3,097,433 | 7/1963 | Cubberly | 33/178 |
| 3,349,498 | 10/1967 | Oliver | 33/178 |
| 3,474,541 | 10/1969 | Cubberly | 33/178 |
| 3,555,689 | 1/1971 | Cubberly | 33/178 |
| 3,600,938 | 8/1971 | Waddell | 73/783 |
| 3,977,468 | 8/1976 | Brewer et al. | 166/241 |
| 4,006,530 | 2/1977 | Nicolas | 33/178 F |
| 4,090,405 | 5/1978 | McKee | 73/151 |
| 4,099,564 | 7/1978 | Hutchison | 166/241 |
| 4,228,593 | 10/1980 | Frank et al. | 33/178 F |
| 4,251,921 | 2/1981 | Fink | 33/178 F |
| 4,523,640 | 6/1985 | Wilson et al. | 166/64 |
| 4,673,890 | 6/1987 | Copland et al. | 33/178 F |
| 4,719,803 | 1/1988 | Capelle et al. | 73/784 |
| 4,760,741 | 8/1988 | Koopmans et al. | 73/784 |
| 4,813,278 | 3/1989 | Kosugi | 73/783 |
| 4,852,262 | 8/1989 | Babcock et al. | 33/178 F |
| 4,932,471 | 6/1990 | Tucker et al. | 166/64 |
| 5,086,645 | 2/1992 | Deaton | 73/151 |
| 5,172,587 | 12/1992 | Long | 73/784 |
| 5,224,274 | 7/1993 | Blaiklock | 33/544 |
| 5,337,613 | 8/1994 | Kovari | 73/784 |

FOREIGN PATENT DOCUMENTS

| | | | |
|---|---|---|---|
| 0063804 | 4/1983 | Japan | 73/803 |
| 1260722 | 9/1986 | U.S.S.R. | 73/803 |

OTHER PUBLICATIONS

"Rod Extensometers with Packer Anchors," Product 121, Code 9020, Interfels GmbH sales brochure, undated, 4 pp.
"Telemac" extensometer product description, undated, 2 pp.
"Waste Isolation Extensometers", Sinco product brochure, 1988, 4 pp.
"Rod–Type Extensometer", Geokon Inc. product brochure, undated, 5 pp.

*Primary Examiner*—Richard Chilcot
*Assistant Examiner*—George M. Dombroske
*Attorney, Agent, or Firm*—Robert A. Wilkes

[57] ABSTRACT

An extensometer for use in a borehole comprises a combination of linear motion transducers located with daisy wheel anchors, which may be attached together if desired with extension bars. Linkages are used to connect the transducers to the daisy wheel anchors. The transducers are set up to measure distance changes both axially along the hole or radially. The extensometer includes at least one axially measuring transducer, and at least two radially measuring transducers. The transducers change in value according to changes in borehole dimensions; the transducer values are monitored electrically.

19 Claims, 4 Drawing Sheets

ROCK EXTENSOMETER

This invention relates to devices used to measure small amounts of movement in a rock or similar formation over time.

Natural rock strata often are exposed to deforming stresses under circumstances in which it is desirable to monitor any resulting deformations. In underground mining removal of material leaves galleries and other void spaces in the strata. The remaining rock is placed under a different set of stresses which can lead to both cracking and crushing of the remaining rock. In an extreme case, excavation failure can occur. Similar problems can arise when excavations are made in close proximity to the foundations of an existing building or other structure.

It is often of importance to be able to monitor what is happening within a rock stratum, such as in the walls and roof of a mine gallery. The easiest way to monitor changes in a rock stratum is to observe any dimensional changes which may take place within the rock itself: a rock under sufficient tension will fail by cracking, and a rock under sufficient compression will crush. In both cases, deformation of the rock should be detectable by a suitably located linear measurement.

The monitoring method commonly used in mines reflects the fact that in such situations complex sophisticated devices are out of place. A more or less straight hole is bored into the rock which is from a meter or so to several meters deep. An anchoring device is then inserted into the hole and a bar, usually of metal, is engaged into the anchor. The anchor is usually at the end of the hole. In some instances, several bars anchored at different places down the hole are used. Rock movement is recorded by measuring movement of the anchored bar at the the end of the (or each) bar relative to the start or collar of the hole. This method has the disadvantages that it is labour intensive, prone to errors of measurement as the dimensional changes involved are generally quite small, prone to errors in recording the measurements, and is capable of detecting only changes in borehole length.

There is consequently a need for a simple, rugged, and easily mountable device which can be left in a test borehole over extended periods of time, and which can detect both axial and radial changes at, or between, selected locations along the axis of the bore hole.

This invention seeks to provide an extensometer device suitable for use in a borehole which is capable of measuring both axial and radial dimensional changes within the hole. As the extensometer of this invention is assembled from a set of more or less standardised components, the user can select the points at which radial changes are to be measured, and the points between which length changes are to be measured. The extensometer of this invention provides an electrical readout which can be retrieved in any suitable fashion.

In the following description and claims by "axial" is meant a dimension essentially along the lengthwise axis of a borehole, and by "radial" is meant a dimension essentially perpendicular to the lengthwise axis of a borehole.

In its broadest embodiment this invention seeks to provide a test borehole extensometer comprising in combination:

at least one first length measuring device, including a first linear motion position transducer, constructed and arranged to provide a first electrical value indicative of an axial measurement of the borehole;

at least one second length measuring device, including a second linear motion position transducer, constructed and arranged to provide a second electrical value indicative of a radial measurement of the borehole;

a plurality of daisy wheel anchoring devices, constructed and arranged to anchor the ends of the length measuring devices at chosen locations along the axis of the borehole;

at least one linkage means attaching the length measurement devices together;

at least two electrical circuit means whereby the electrical values indicative of distances measured within the borehole can be retrieved; and an insertion and retrieval pin at one end of the extensometer whereby the extensometer is inserted into and retrieved from the borehole.

Preferably the transducers in the length measurement devices comprise variable resistances, whose resistance value is changed by a change in the measured distance. More preferably, all of the transducers comprise variable resistances. Most preferably, all of the transducers are the same.

Preferably the daisy wheel anchors locate the measuring devices substantially in the center of the borehole, and clear of its walls.

Preferably the extensometer includes at least one axial length measuring device, and two radial measurement devices.

Preferably, when a plurality of radial length measurement devices are included, they are aligned to provide measurements on different radial axes. More preferably, when two radial length measurement devices are included, they are aligned to measure radial changes substantially perpendicularly to each other.

Preferably the insertion and retrieval pin comprises a threaded member which accepts a conventional drill string rod. Most preferably, the pin is constructed with a male thread adapted to receive a female threaded drill rod end.

In a preferred embodiment, the extensometer further includes separate locking means attached to each length measuring device constructed and arranged to protect the linear motion position transducers during insertion of the extensometer into the borehole, and which are removed after the extensometer is in place.

In a further preferred embodiment, the extensometer comprises in sequence from one end:

an insertion and retrieval pin;

at least one axial length measuring device having two daisy wheel anchors associated therewith and adjacent each of the ends thereof;

at least one daisy wheel anchoring device located adjacent an end of the or each additional axial length measuring device remote from the pin;

a first radial measuring device; and a second radial measuring device arranged to measure perpendicularly to the first radial measuring device, together with both sufficient linkage means to attach the length measurement devices together, and sufficient electrical circuit means to enable the measured values to be retrieved.

The extensometer will now be described in one embodiment by way of reference to the attached Figures in which.

The embodiment shown in the Figures incorporates a linear motion position transducer. There are several varieties of these available which utilize a variable resistance. Other devices which utilize changes in inductance, in capacitance and which utilize materials whose electrical characteristics change with the applied stress (commonly called strain gauges) are also known. In the extensometer shown in the FIGS., a variable resistance device with a maximum travel of 15 cms (6 inches) is used. Movement of the linking rod results in a change in the value of the variable resistance, which can be measured by a suitable electrical circuit. The transducers used were units made by Waters Manufacturing Inc. of Wayland, Mass. The units have a nominal resistance of 5,000 ohms, an accuracy of 0.1%, and an incremental sensitivity of 0.0013 mm. A water tight sealed unit is also available if required. The electrical connections were made to the transducer in accordance with the manufacturer's instructions. In appearance, the transducer comprises an elongate substantially square section box, with a rod protruding from one end. The end of the rod is provided with a thread, and the other end of the box is provided with attachment means, and a cable outlet. Since response to axial and radial change will not necessarily be the same, calibration of the transducers before use might be desirable.

Figure 1:
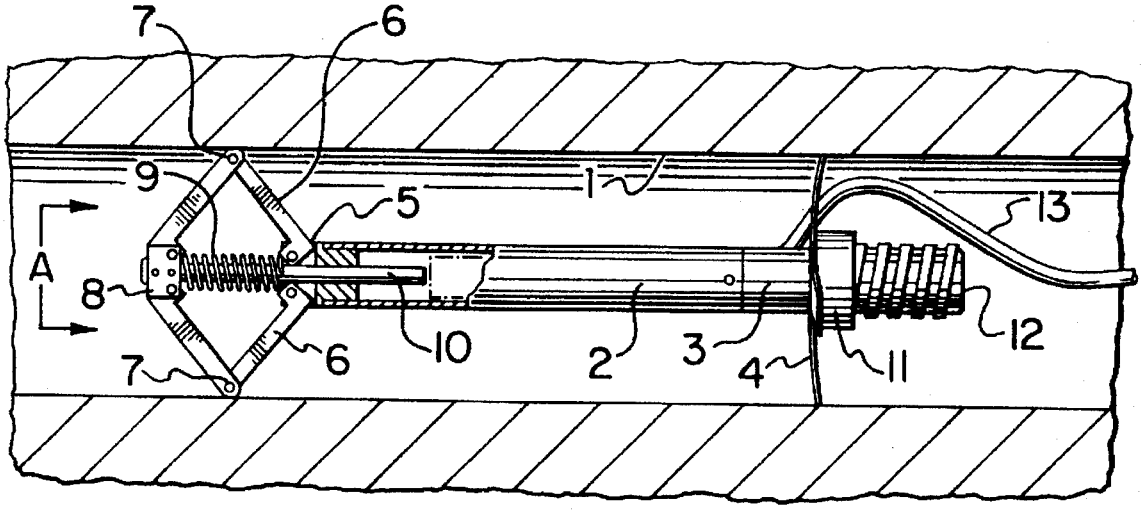
FIG. 1 shows a single radial measuring device in place in a borehole.

In FIG. 1 the borehole, shown generally at 1 has inserted into it only a radial measurement device. This comprises the transducer 2 which has attached at one end a linkage device 3 to which is attached a daisy wheel anchor 4, which can be better seen in FIG. 2. The daisy wheel 4 anchors the transducer 2 in the borehole 1. The radial measuring device is attached to the other end of the transducer 2. It comprises a block 5 attached to the case of the transducer carrying two pairs of arms 6 which can bend about the pivots 7, and which are attached to the block 8 to make up a pantograph linkage. The blocks 5 and 8 include suitable pivots for the arms 6. The block 8 is also attached to the spring 9 and the transducer operating rod 10. The spring 9 is in tension, so that as it urges the block 8 toward the body 2 of the transducer, it urges the arms 6 outward to contact the borehole. This arrangement can also be seen in FIG. 2. A change in diameter of the borehole will result in movement of the arms 6, which will move the rod 10, and alter the value of the variable resistance in the transducer. This change is read by suitable electrical means (not shown) attached to the electrical circuit means 13. Adjacent the daisy wheel anchor 4 a retrieval pin 11 is also attached to the linkage device 3. The retrieval pin 11 has a male thread 12 which is a standard drill string rod thread.

Figure 2:
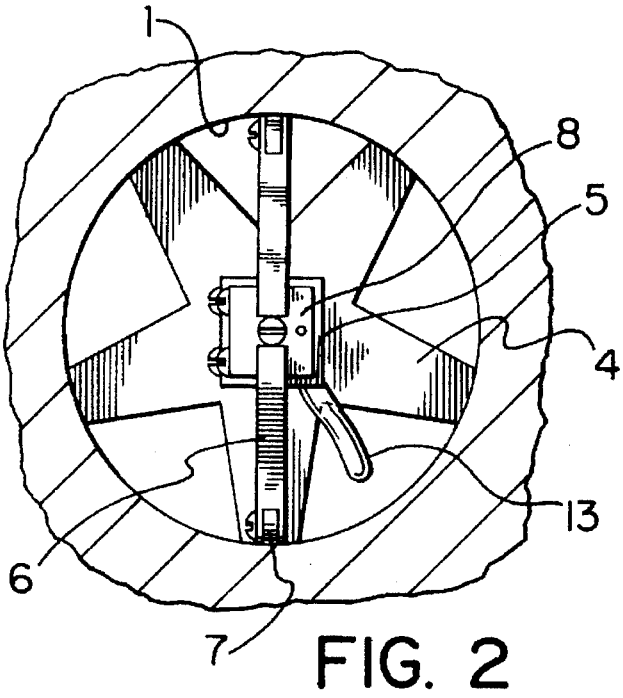
FIG. 2 shows the measuring device of FIG. 1 from the direction A in FIG. 1.

As can be seen in FIG. 2, the electrical lead is accommodated between the petals of the daisy wheel anchor. These petals serve to anchor the extensometer in place in the borehole.

Figure 3:
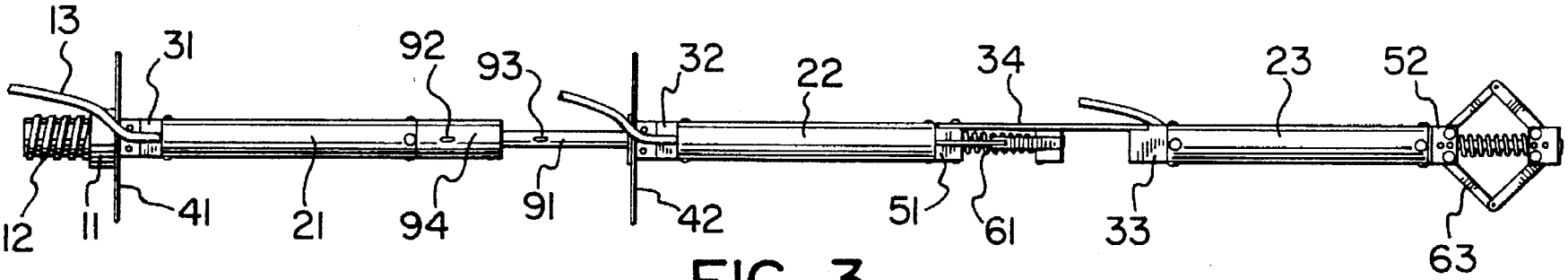
FIGS. 3 and 4 show two views of a complete extensometer.
Figure 4:
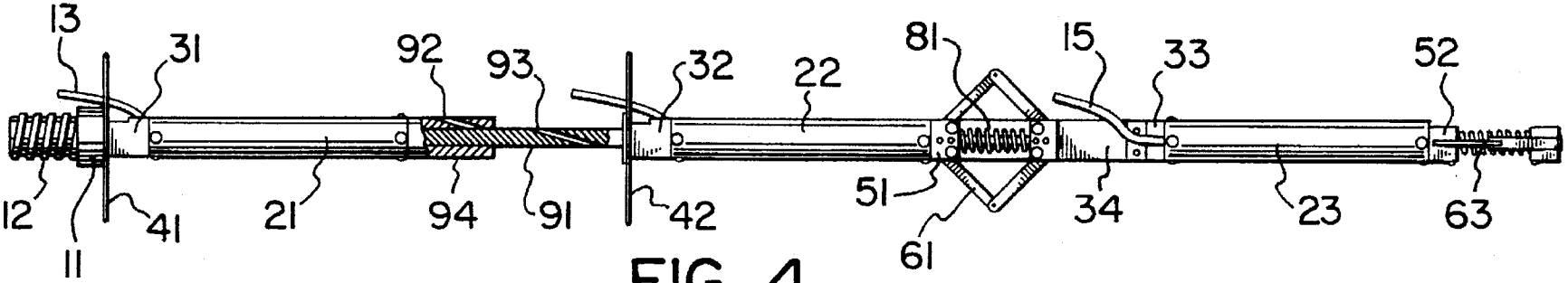

In FIGS. 3 and 4 are shown two views of most of the parts of a typical assembled extensometer. For clarity, some radial unit springs, and the required electrical circuit leads are omitted from these Figures.

Starting from the left end of these Figures, the parts in sequence are retrieval pin 11; first daisy wheel anchor 41; first linkage means 31; axial measuring device 21; second linkage means 32 to which a second daisy wheel anchor 42 is attached; first radial measuring device 22; third linkage means 34; and second radial measuring device 23.

In this sequence, the operating rod 91 of the transducer 21 is directly attached to the linkage 32. Conveniently, the linkage is provided with a threaded bore to accept the rod end thread directly. The linkage 34 is a flat plate strip attached at one end to the block 51 which carries the arms 61, and at the other end to a block 33 attached to the third transducer 23. This plate is arranged to clear the arms 61, and to allow sufficient travel of the rod in the transducer 22. If it is required to make both radial measurements close together, the strip 34 is made long enough to allow the third transducer to be reversed, to place the arms 61 and 63 together.

When placed into the borehole, the first transducer 21 responds to changes in axial distance between the daisy wheel anchors 41 and 42. The second and third transducers 22 and 23 respond to changes in radius indicated by movements of the two sets of arms 61 and 63 independently. As shown, the arms 61 and 62 are set perpendicular to each other; if desired, other angles can be used.

FIGS. 3 and 4 also show the preferred arrangement of a sequence intended to monitor both axial and radial changes. It is preferred to locate the radial measurements at the far end of the string, which will usually be near to the end of the hole. However, if radial measurements are needed other than at the end, then radial units can be placed elsewhere. It is also possible to incorporate more than one axial measuring device. This can be done in two different ways.

The first is to locate the axial measurement devices with a daisy wheel at the pin end, much as is shown in FIG. 3, and with further single daisy wheel anchors between each axial measurement device. A final daisy wheel anchor is placed after the last one. In this arrangement in addition to the changes in length reported by each transducer the individual values for adjacent transducers are additive so that readings can be taken over a distance greater than the separation between any two daisy wheels.

The second is to locate each axial measurement device between two daisy wheels. In that case, each device measures axial changes independently of its neighbours.

Combinations of these two arrangements can also be used.

Figure 7:
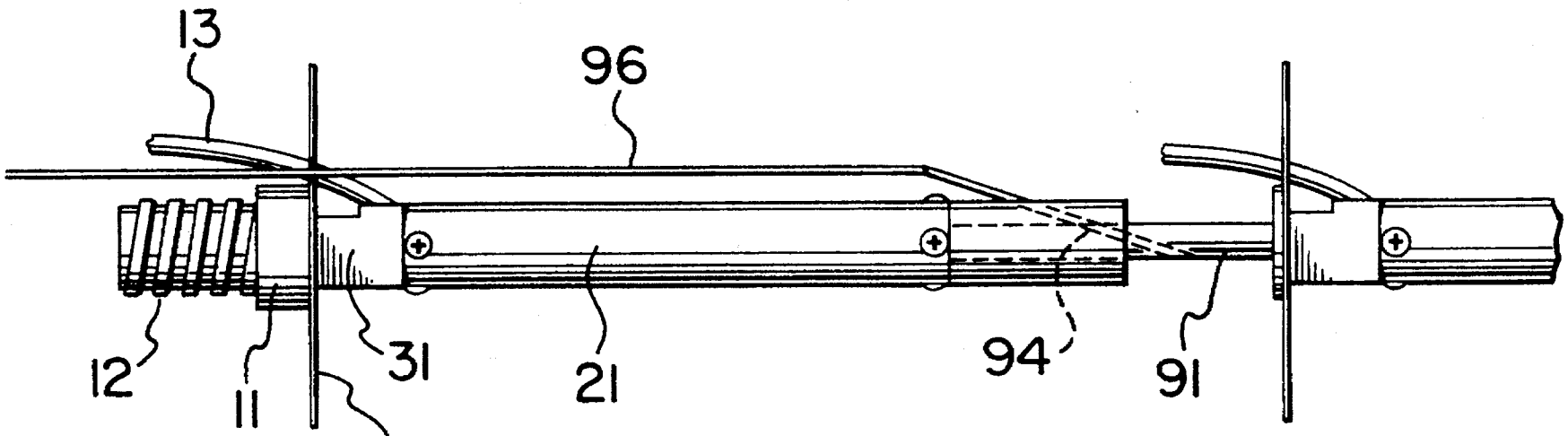
FIG. 7 shows the locking device used during insertion of the extensometer into the borehole.

When the extensometer is being inserted into the bore hole the transducers may need to be protected, as otherwise movement of the whole string into the borehole can result in transducer damage. It is to be noted that these holes are not usually bored internally smooth, as a percussion drill is often used rather than a diamond drill. For the radial units a simple sleeve or the like can be used, which is pulled off once the extensometer is in place, thus allowing the springs to urge the arms outward and into contact with the borehole walls. The axial units require more consideration, as these have to sustain the forces needed to push the daisy wheel anchors along the borehole. A convenient arrangement is shown in FIGS. 4 and 7. Two angled bores, as at 92 and 93, are made in the casing and in the rod 91 of the transducer 21. Generally, the holes are located to give the desired "zero" point for the transducer: often this will be at midpoint of the available travel, but other locations can be used. For insertion, a pin 94 is inserted into the holes 92 and 93 locking the transducer. When the extensometer is in place, the pin is removed by means of the cord or wire 96 thus freeing the rod 91. The same arrangement can also be used for radial measurement units.

Figure 5:
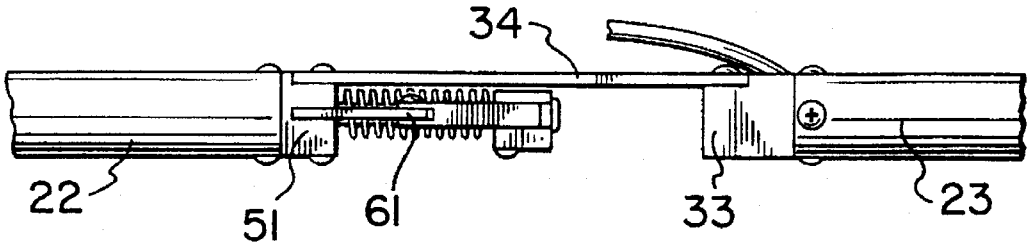
FIG. 5 shows in detail the short linkage used in FIGS. 3 and 4.

Several means can be used to connect the linear motion position transducers together. A simple one is shown in FIG. 5, inserted between two transducers 22 and 23. Transducer 22 has a flat face provided on the mounting block 51 which carries the radial arms 61. A similar block 33 also having a flat face is attached to the other transducer 33. The two blocks are linked together by the stiff flat strip 34, which is attached to each of the blocks in any suitable way, such as by set screws.

Figure 6:
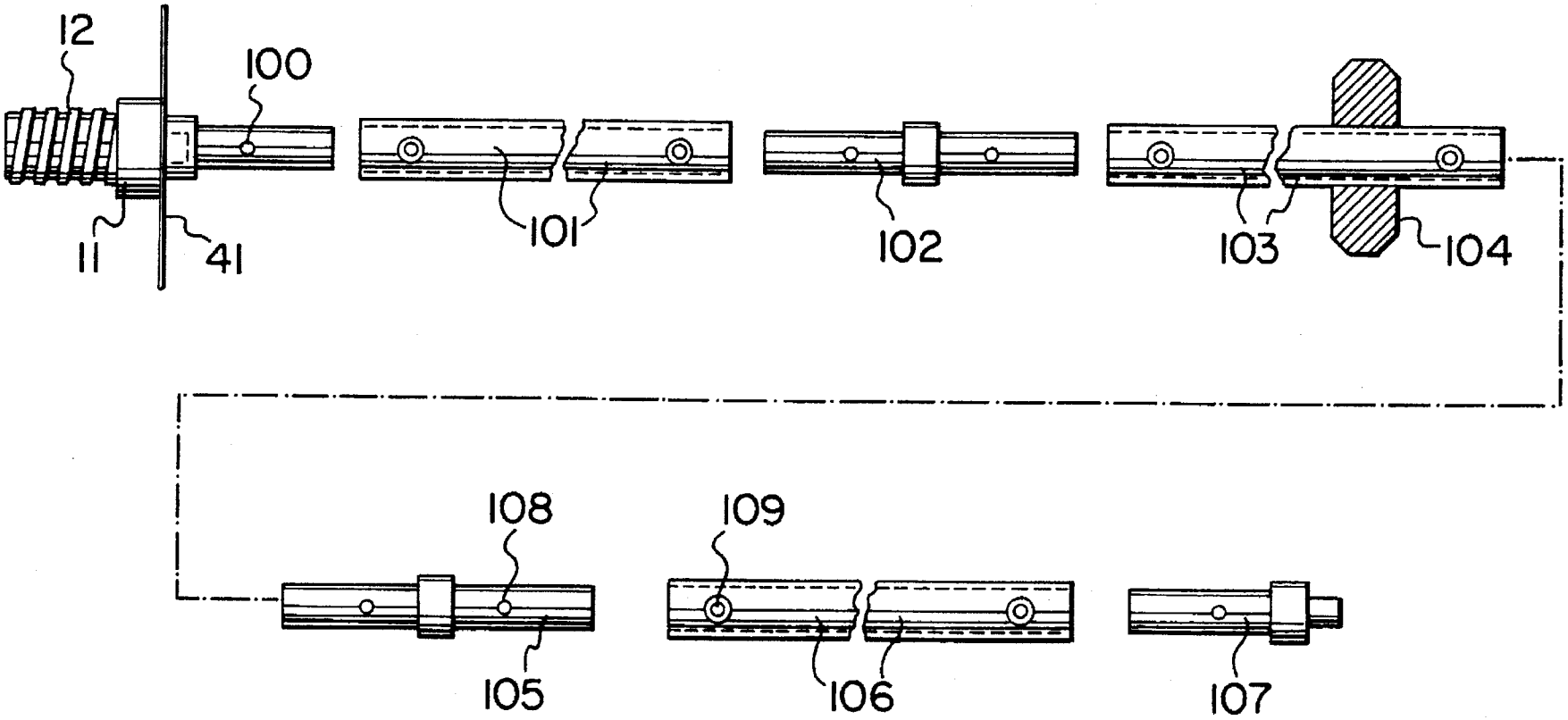
FIG. 6 shows an extension bar which is used in long boreholes.

For long or deep holes it may be desirable to include extension bars in the extensometer. These can be used both to extend the separation between which axial measurements are made, or simply to locate two transducers further apart. In FIG. 6 a suitable extension bar unit is shown. If desired, two, or more, extension units can be attached together to make up a longer string. They can either be used at an end of the string, as shown, or within the length of the string either to increase the distance over which axial measurements are taken, or to place the transducers further apart.

As shown, the end of the string comprises a retrieval pin 11 with a thread 12; a daisy wheel anchor 41 is also attached to the retrival poin. In certain circumstances, the daisy wheel may be omitted. Attached to the pin 12 is an extension bar attachment 100. At the other end, a similar attachment 107 is attached to the next unit in the extensometer string (not shown). In between these end attachments are a sequence of extension tubes, of which three are shown at 101, 103, and 106, joined together by double ended couplings, such as 102 and 105. As shown, the tube ends and the couplings have cooperating holes 108 and 109, into which suitable fixing means are inserted to hold the tubes and couplings together. It is preferred to provide the coupling hole 108 with a thread, and to use a screwed in bolt as the fixing means, but other methods are well known.

When more than one extension tube is in use it is desirable to ensure that the extension bar stays reasonably central within the bore hole. This is conveniently achieved by fitting a donut shaped ring, shown in cross section at 104, to one of the tube sections. Other ring cross sections can also be used. The ring is suitably made from nylon, polythene, polytetrafluoroethylene, or the like. In use, it is eased onto the tube section before the couplings are attached. To aid insertion, the rings are made a loose fit in the bore hole.

Most of the parts of the extensometer are conveniently made from metal. The transducer cases are usually steel or brass, the linkage means are brass strips, and the extension bars, if used are generally of steel. It is also convenient to make the daisy wheel anchors from thin sheet steel. However, it should be borne in mind that in some mining situations the ground water can be quite corrosive, and therefore it may be necessary to use sealed transducers and corrosion resistant materials. For example, both the daisy wheel anchors and the extension bars can be fabricated from fibre reinforced plastics.

The measurements provided by the transducers can be retrieved by any suitable method. If real time monitoring is deemed necessary, permanent electrical connections to a direct reading instrument such as an automatic digital read out or a chart recorder can be made. Alternatively, if readings are to be taken sporadically, it is sufficient to obtain each reading by attaching a suitable electrical device temporarily to the extensometer, which will also conveniently record the reading. Conversion of the resistance, or other values, provided by the transducers into length indications is accomplished by any suitable means.

I claim:

1. A test borehole extensometer, adapted to measure rock deformation caused by rock failure under tension, or under compression, or under both tension and compression, comprising in combination:

at least one first length measuring device, including a first linear motion position transducer, constructed and arranged to provide a first electrical value indicative of an axial measurement of the borehole;

at least one second length measuring device, including a second linear motion position transducer, constructed and arranged to provide a second electrical value indicative of a radial measurement of the borehole;

a plurality of daisy wheel anchoring devices, constructed and arranged to anchor the ends of the length measuring devices at chosen locations along the axis of the borehole;

at least one linkage means attaching the first and second length measurement devices together;

at least two electrical circuit means whereby the electrical values indicative of distances measured within the borehole can be retrieved; and an insertion and retrieval pin at one end of the extensometer whereby the extensometer is inserted into and retrieved from the borehole.

2. An extensometer according to claim 1 wherein the linear motion position transducers include variable resistance devices.

3. An extensometer according to claim 1 wherein the linear motion position transducers consist of variable resistance devices.

4. An extensometer according to claim 1 wherein the linear motion position transducers comprise variable resistance devices which are all the same.

5. An extensometer according to claim 1 wherein the daisy wheel anchors locate the measuring devices substantially in the center of the borehole, and clear of its walls.

6. An extensometer according to claim 1 which includes at least one axial length measuring device, and at least two radial measurement devices.

7. An extensometer according to claim 1 which includes one axial length measuring device, and two radial measurement devices.

8. An extensometer according to claim 1 which includes at least one axial length measuring device, and at least two radial measurement devices wherein the radial length measurement devices are aligned to provide measurements on different radial axes.

9. An extensometer according to claim 8 which includes at least one axial length measuring device, and at least two radial measurement devices wherein the radial length measurement devices are aligned to provide measurements substantially perpendicularly to each other.

10. An extensometer according to claim 1 which includes one axial length measuring device, and two radial measurement devices wherein the radial length measurement devices are aligned to provide measurements on different radial axes.

11. An extensometer according to claim 10 which includes one axial length measuring device, and two radial measurement devices wherein the radial length measurement devices are aligned to provide measurements substantially perpendicularly to each other.

12. An extensometer according to claim 10 wherein the pin is constructed with a male thread adapted to receive a female threaded drill rod end.

13. An extensometer according to claim 1 wherein the insertion and retrieval pin comprises a threaded member which accepts a conventional drill string rod.

14. An extensometer according to claim 1 further including separate locking means attached to each length measuring device constructed and arranged to protect the linear motion position transducers during insertion of the extensometer into the borehole, and which are removeable after the extensometer is in place.

15. An extensometer according to claim 1 further including extension bar means.

16. An extensometer according to claim 15 wherein the extension bar means includes at least one centralising means.

17. An extensometer according to claim 1 comprising in sequence from one end an insertion and retrieval pin;

at least one axial length measuring device having two daisy wheel anchors associated therewith and adjacent each of the ends thereof;

at least one daisy wheel anchoring device located adjacent an end of each additional axial length measuring device remote from the pin;

a first radial measuring device; and a second radial measuring device arranged to measure perpendicularly to the first radial measuring device, together with both sufficient linkage means to attach the length measurement devices together, and sufficient electrical circuit means to enable the measured values to be retrieved.

18. An extensometer according to claim 17 further including extension bar means.

19. An extensometer according to claim 18 wherein the extension bar means includes at least one centralising means.

* * * * *